US006764041B2

(12) United States Patent
Oron

(10) Patent No.: US 6,764,041 B2
(45) Date of Patent: Jul. 20, 2004

(54) IMAGING DEVICE AND METHOD

(75) Inventor: Eliezer Oron, Kfar Saba (IL)

(73) Assignee: GEO.T. Vision Ltd., Kfar-Saba (IL)

( * ) Notice: Subject to any disclaimer, the term of this patent is extended or adjusted under 35 U.S.C. 154(b) by 0 days.

(21) Appl. No.: 10/166,728

(22) Filed: Jun. 12, 2002

(65) Prior Publication Data

US 2003/0127009 A1 Jul. 10, 2003

(30) Foreign Application Priority Data

Jun. 12, 2001 (IL) ..... 143694

(51) Int. Cl.[7] ..... F41G 7/00; F41G 9/00

(52) U.S. Cl. ..... 244/3.16; 244/3.1; 244/3.15; 342/61; 342/68

(58) Field of Search ..... 342/24, 25, 61, 342/62–66, 175, 176, 179, 185, 190–197, 67, 68; 244/3.1, 3.15, 3.16–3.19

(56) References Cited

U.S. PATENT DOCUMENTS 3,653,737 A 4/1972 Stripling et al.
3,721,410 A 3/1973 Anspacher
3,962,537 A 6/1976 Kearns et al.
4,009,848 A * 3/1977 Albert et al. ..... 244/3.16
4,431,150 A 2/1984 Epperson, Jr.
4,438,893 A 3/1984 Sands et al.
4,512,537 A 4/1985 Sebestyen et al.
4,543,603 A 9/1985 Laurès
4,561,611 A 12/1985 Sinclair et al.
4,583,703 A 4/1986 Kline
4,679,748 A 7/1987 Blomqvist et al.
4,917,330 A 4/1990 Dulat et al.
5,077,465 A 12/1991 Wagner et al.
5,201,895 A 4/1993 Grosso
5,379,968 A 1/1995 Grosso
5,467,681 A 11/1995 Liberman
5,529,262 A 6/1996 Horwath
5,669,580 A * 9/1997 Strauss ..... 244/3.16
5,669,581 A 9/1997 Ringer
6,116,537 A * 9/2000 Kempas ..... 244/3.16
6,193,188 B1 * 2/2001 Ahmad et al. ..... 244/3.16

* cited by examiner

*Primary Examiner*—Bernarr E. Gregory
(74) *Attorney, Agent, or Firm*—Browdy and Neimark, P.L.L.C.

(57) ABSTRACT

An imaging fuse comprising a housing fixable within a receptacle at a fore end of a projectile, a coaxial support frame rotatably supported within the housing and fitted with an imaging assembly. The support frame is axially displaceable with respect to the housing. An axial shock absorbing system is provided intermediate the housing and the support frame, and a spin suppressing mechanism is associated with the support frame, for suppressing rotation of the support frame with respect to the housing.

32 Claims, 4 Drawing Sheets

IMAGING DEVICE AND METHOD

FIELD OF THE INVENTION

This invention relates to an imaging device. More specifically the invention is concerned with an imaging fuse attachable to an airborne object, such as a projectile. The invention is also concerned with a system and method making use of such an imaging device.

The term projectile as used herein the specification and claims is used to denote any type of launched/fired object, either self propelled e.g. a rocket, a missile, etc, or a kinetic projectile e.g. a shell, a projectile fired from a gun or canon, a mortar, a high caliber machine gun, etc.

BACKGROUND OF THE INVENTION AND PRIOR ART

An imaging projectile may be of many configurations and may be launched towards its destination by different means. The projectile may be a self-propelled type in which it is fitted with a rocket or other type of engine and may also comprise remote control or other steering arrangements for guiding the projectile towards its destination. The projectile may alternatively be a kinetic body launched/fired from a gun by a charge, e.g. from a mortar, a gun or a cannon.

The projectile may have apart from its imaging function also other purposes, e.g. it may comprise an explosive charge which is adapted to explode above or at a target or it may comprise an illuminating body which will be expelled from the projectile above the target area for illumination, as known, per se, etc.

An imaging projectile may be used for non-military purposes, e.g. for aeronautic experiments where it is required to examine aeronautic behavior and performances of a body during flight or free fall. Rather than using an air tunnel which requires sophisticated logistics, it is possible to launch the body by a suitable carrying projectile fitted with an imaging assembly which transmits an image to a receiving station during trajectory of the projectile. By analyzing the image obtained at the receiving station one may obtain the required telemetry parameters by monitoring the vibrations, course of flight, etc.

An imaging projectile may also be used for fast obtaining of prompt images of regions which are inaccessible, e.g. for obtaining geological and other information such as damage assessment during an earthquake or volcanic eruptions, during a large scale fire or a flood, etc.

Among the many uses of an imaging projectile, one should mention also its military use as a reconnaissance aid for obtaining an image of a territory at real time and at essentially low cost without complicated logistics.

In general, imaging systems of the concerned type fall into several categories:

- Shells with a line array sensor (LAS) wherein a high roll speed of the projectile is used to scan the target area and provide a common two-dimensional image;
- A projectile with a stabilizing pin assembly, which pins project during a certain stage of flight in order to stop the roll and thus enable obtaining an image with a regular video camera;
- A projectile adapted for disintegrating during trajectory and release an imaging sensor, typically a camera or video camera suspended from a parachute or balloon;
- A projectile utilizing a gyroscope system to prevent spin with suitable imaging mechanisms;
- A projectile, typically a guided one, wherein a fiber optic line extends behind the projectile towards a pick up station wherein image data is received.

A myriad of publications disclosed imaging projectiles and imaging fuses for different purposes, as well as methods and devices for improving such apparatuses, in particular improving stability of an imaging projectile during its trajectory, improving impact resistance and other launched imaging systems among these are: U.S. Pat. Nos. 3,653,737, 3,721,410, 3,962,537, 4,431,150, 4,438,893, 4,512,537, 4,543,603, 4,561,611, 4,583,703, 4,679,748, 4,917,330, 5,077,465, 5,201,895, 5,379,968, 5,467,681, 5,529,262, 5,669,581. A micro-reconnaissance imaging system has also been disclosed by the Xybion Corporation in their Website at Xybion.com therefor.

However, the above disclosed references involve some technical drawbacks such as, for example, some of the above references are not designed to withstand the high G shock during launching which can range between around 6,0005 G in the case of launching a projectile from a mortar or up to about 80,000 G in some particular cases of firing a projectile from a tank's gun.

Still another typical problem concerned with projectiles of the concerned type is the significantly high speed of rotation (spin), at times in the order of about 20,000 RPM, which renders the imaging process impossible as the obtained image smears.

Another common problem which occurs with imaging projectiles fitted with imaging fuses is the strong vibrations during trajectory which distort the image and which together with the smeared image owing to spinning of the projectile, yield a useless image.

Even more so, the dimensions of the imaging fuse which may be attached to an imaging projectile are constraint and thus the power supply means and signal transmission components are of restricted dimensions and power. This results in requiring special tracking equipment, either ground or airborne, for tracking the trajectory of the projectile and for picking up and processing an image transmitted from the imaging fuse.

Still another drawback of recognizance and imaging devices is their ability to provide an image at poor conditions such as essentially low cloud bed, dust or smoke.

It is an object of the present invention to provide an improved imaging projectile and an imaging fuse therefor which overcome the above drawbacks. The invention is further concerned with an imaging system making use of an imaging device in accordance with the present invention and further, an imaging method for easily obtaining an image of a remote target area.

SUMMARY OF THE INVENTION

According to a first of its aspects, the invention is directed to an imaging fuse comprising a housing fixable within a receptacle at a fore end of a projectile, a coaxial support frame rotatably supported within the housing and fitted with an imaging assembly, said support frame being axially displaceable with respect to the housing; an axial shock absorbing system intermediate the housing and the support frame; and a spin suppressing mechanism associated with the support frame, for suppressing its rotation with respect to the housing.

The invention is further concerned with an imaging projectile fitted at a fore end thereof with an imaging fuse comprising a housing, a coaxial support frame rotatably supported within the housing and fitted with an imaging assembly, said support frame being axially displaceable with respect to the housing; an axial shock absorbing system intermediate the housing and the support frame; and a spin suppressing mechanism associated with the support frame, for suppressing its rotation with respect to the housing.

By still another aspect of the invention there is provided an imaging system comprising:

i) a projectile formed at a fore end (also referred to as a nose tip) thereof with a fuse receptacle;

ii) an imaging fuse in accordance with the invention, fixable to said fuse receptacle;

iii) a launching mechanism for launching the projectile towards a target area;

iv) a tracking system for locating and tracking the trajectory of the projectile; and v) an image data receiving and image processing unit adapted for picking up image data transmitted from the fuse and processing it into a solved image.

The term solved image as referred to in the specification and claims refers to an image in which particulars of a target area are recognizable and/or to an image of which the geographic ordinates of each pixel are known. However, for obtaining a solved image it is required to obtain a reference image database of the target area.

The invention is further directed to a method for obtaining an image of a target area, the method comprising:

i) launching an imaging projectile fitted with an imaging fuse in accordance with the present invention;

ii) locating the position of the projectile and tracking it along its trajectory; and iii) receiving image data transmitted from the image fuse and processing it into a solved image.

By one particular embodiment, the invention further suggests that the data receiving and image processing unit further comprises a reference image database and wherein the image received at the image processing unit is compared with the reference image data for identifying location of the projectile and for assessing differences between the reference image and the processed image captured by the projectile.

BRIEF DESCRIPTION OF THE DRAWINGS

In order to understand the invention and to see how it may be carried out in practice, an embodiment will now be described, by way of non-limiting example only, with reference to the accompanying drawings, in which:

FIG. 2 are schematic illustrations of three respective positions of a shock absorbing mechanism according to the present invention, wherein:

DETAILED DESCRIPTION OF A SPECIFIC EMBODIMENT

Figure 1:
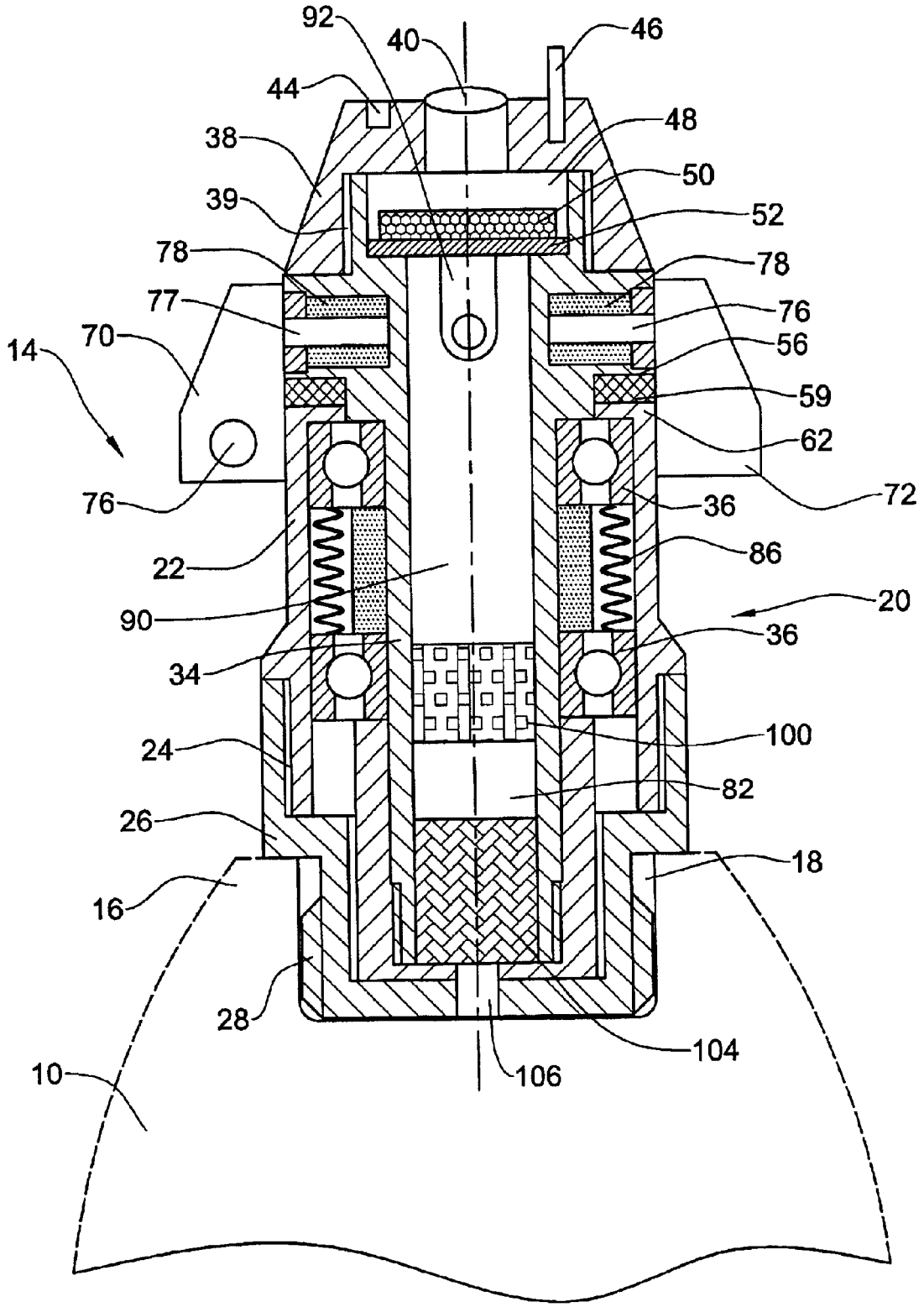
FIG. 1 is a longitudinal section through a front portion of a projectile fitted with an imaging fuse according to the present invention.

Attention is first directed to FIG. 1 of the drawings wherein a projectile designated 10 (only a front portion thereof is shown, in dashed lines) is fitted with an imaging fuse in accordance with the present invention generally designated 14. For the sake of example only, projectile 10 is a shell adapted for launching from a gun. Projectile 10 is formed at its fore end 16 with a fuse receptacle 18 for readily coupling thereto a fuse by screw engagement, though other coupling arrangements are also possible e.g. bayonet coupling etc. It is to be appreciated that the imaging fuse 14 is merely an option whereas other fuses may be coupled thereto for igniting the main charge of the projectile 10, e.g. a strike fuse, a delay fuse, a heat sensing fuse, etc.

The imaging fuse 14 comprises a housing 20 consisting of a front housing member 22 screw coupled at 24 to a rear housing member 26 formed in turn, at its rear end with a threading 28 for screw engagement within receptacle 18 of the projectile 10. Once the fuse is coupled to projectile 10, it is considered that the housing 20 is rotatably fixed to the projectile.

A support frame 34 is rotatably supported within housing 20 by means of two roller bearings 36, whereby it is freely rotatable, and is coaxially received within the assemblage. A dome 38 (also known as radome) is fitted at the front of support frame 34, e.g. by screw coupling at 39. Dome 38 is provided at its fore end with an optical lens 40 coaxially supported therein. An IR illuminator 44 is fitted in the dome 38, as well as an RF beacon 46.

Coaxially extending behind the optical lens 40 and received within a cavity 48 of the support frame 34 there is an imaging sensor 50 fitted over a cushioning (shock absorbing) member 52, made of a suitable resilient, essentially elastic material.

Figures 2A, 2B, 2C:
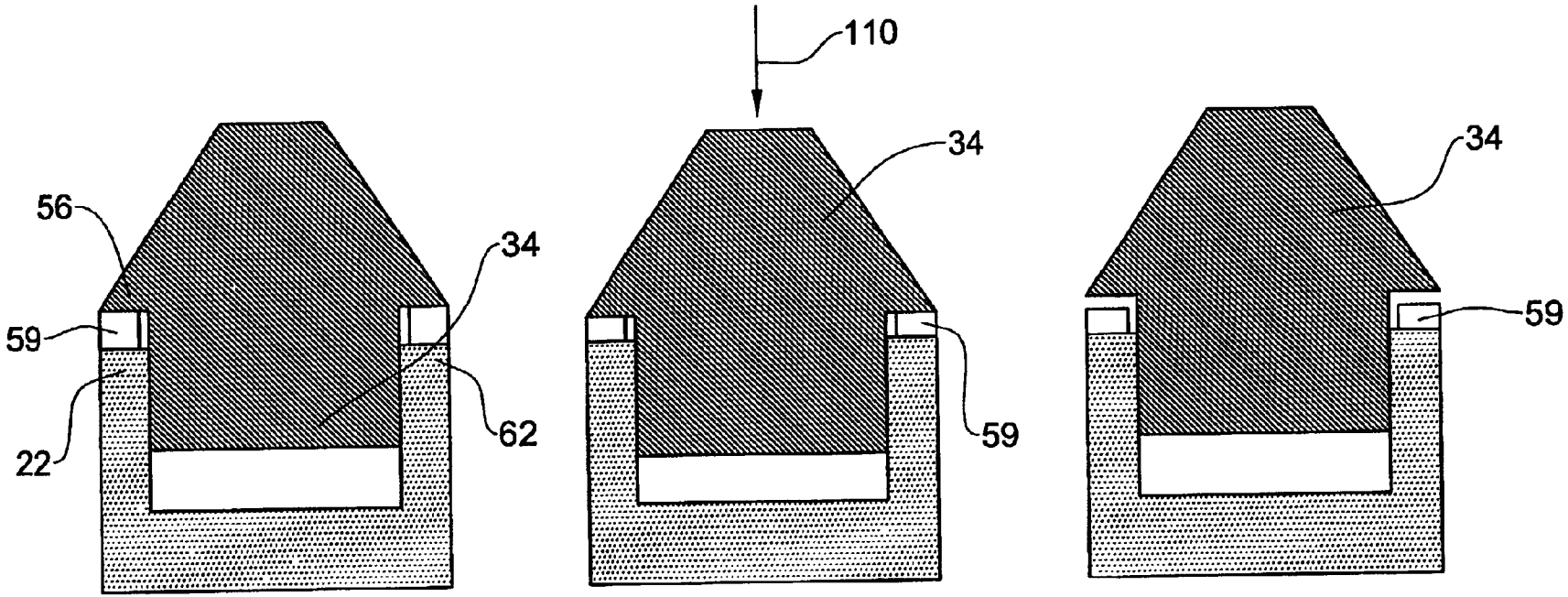
FIG. 2A illustrates the shock absorbing mechanism at rest, before launching the projectile.
FIG. 2B illustrates the shock absorbing mechanism during launching of the projectile.
FIG. 2C illustrates the shock absorbing mechanism during gliding of the projectile.

An important feature of the imaging fuse 14 is its ability to withstand axial acceleration generated during launch of the projectile (G forces). Support frame 34 has a laterally extending flanged portion 56 which in rest, i.e. prior to launching rests against a shock absorbing ring 59 made of a material having plastic characteristics, for example of Teflon™ which ring bears in turn against a corresponding flanged portion 62 of the front housing member 22. This arrangement is schematically represented in FIG. 2A.

The fuse 14 further comprises two fins 70 and 72, the former being fitted with a magnetic compass 76, the purpose of which will become apparent hereinafter. However, another number of fins may be provided in different designs.

Fins 70 and 72 are articulated to the support frame 34 by radially extending axles 77, each articulated to a corresponding actuator 78.

Fuse 14 is further fitted with a battery 82 and a power generator 86 which is activated by the relative rotation between the support frame 34 and the front housing member 22. An RF transmitter 90 extends within the support frame 34 fitted with an antenna 92. Also provided within the support frame 34 is a CPU designated 100 and further, at a rear most end of the support frame 34 there is an ignition fuse 104 extending opposite an ignition tube 106 formed in the rear housing member 26.

It is readily understood that all the electrical and electric components are inter connected by suitable circuitry, as required, for imparting fuse 14 with the required qualities, as will be specified hereinafter.

Further attention is now directed also to FIGS. 2A–2C for understanding how the shock absorbing mechanism of the device operates. As mentioned in the introduction of the specification, the axial forces (known as G forces) acting on the projectile during launching may reach values of up to 80,000 g. One of the major problems concerned with imaging devices is their ability to withstand such high g forces and for that purpose the shock absorbing mechanism is provided.

FIG. 2A illustrates the position whilst the projectile is at rest, i.e. before launching. In this position the cushioning Teflon™ ring 59, which as mentioned above has plastic characteristics, is at its expanded position snugly fitted between the corresponding flanged portions 56 and 62 of the support ring 34 and the front housing member 22. Upon firing the gun from which the projectile is launched, the support frame 34 is axially displaced in the direction of arrow 110 in FIG. 2B entailing compression of shock absorbing ring 59, thus avoiding damage to the components fitted in the support frame 34. When the projectile with the associated fuse 14 reach an essentially steady state, namely gliding or free fall, the support frame 34 slowly returns to its original position, disengaging from the shock absorbing ring 59 which, owing to its plastic characteristics, remains in its compressed position, as illustrated in FIG. 2C.

Reference is made back to FIG. 1 for understanding how the imaging assembly operates. In order to obtain a clear image, it is necessary to retain the lens 40 and the imaging sensor 50 in a steady state, i.e. non-rotational with respect to the ground (earth), in spite of the high revolution speed of the projectile during its trajectory. For that purpose, fins 70 and 72 are provided which significantly suppress the rotation of the support frame 34 with respect to the housing 20 (and the associated projectile) owing to friction forces applied thereto during flight. It is possible to obtain practically a fixed state, i.e. absolutely no rotation of the support frame 34 with respect to the ground, by means of the magnetic compass 76 fitted on fin 70 which continuously senses the magnetic field of the earth and issues a signal to the CPU 100, the latter processing this data and generating a correction signal to fins' actuator 78 whereby the fins acquire a suitable angle so as to suppress rotation of the support frame 34.

Whilst a power generator 86 is provided, the fuse is fitted with a power source 82 which may be either a backup power source or for providing power at those instances where there is insufficient relative rotation between the support frame 34 and the front housing member 22.

When the projectile is a non-spin shell, e.g. a mortar shell, thus rotation stabilizing is not relevant. In such a case the imaging fuse may be such that the support frame is integral with or fixedly attached to the housing components, i.e. there is no relative translation therebetween. In such case, where it required to install a power generator, then fins are provided, giving rise to forced rotation between respective components of the housing, ad where the power generator is fitted so as to pick up said rotation. According to an embodiment of the invention, the imaging fuse is fitted for selecting its mode of operation, namely between a rotational mode wherein the support frame is rotatable with respect to the housing, and a fixed, non-rotational mode, wherein the support frame is rotationally fixed with respect to the housing, by suitable engagement means, e/g/ a removable pin, etc.

IR illuminator 44 may continuously generate an illuminating beam or may be lit only at a certain state of the trajectory, e.g. when the projectile is in a free fall where it is essentially perpendicular to the ground surface or upon reaching a predetermined distance from the ground. With the IR illuminator activated it is possible to obtain an image also at poor illumination conditions when using a visible light image sensor. However, it is to be appreciated that the image sensor may be an IR sensor, a visible light sensor or a millimetric light wave sensor.

A significant advantage of the device of the present invention is its ability to provide an image also at essentially low altitude e.g. as low as about 10 meters. This character makes it possible to obtain an image at extreme atmospheric and environmental conditions such as a low cloud bed, heavy rain, dust etc.

The RF beacon 46 is provided for generating a location signal at least at the initial stage after launching the projectile, which signal may then be picked up by a tracking assembly for determining the location of the imaging projectile, as will be explained with reference to FIG. 3. Typically the RF beacon will generate queuing signal pulses which enable a tracking station to locate the projectile during its trajectory, and trace it. The frequency of the RF beacon 46 may be the same or different then that of the image transmitter 90.

An image viewed through lens 40 is sensed by image sensor 50 and is then processed by CPU 100 and transmitted via transmitter 90 and antenna 92 to a receiving station, stationary or airborne, as will be explained with further reference to FIG. 3. It is further appreciated that the fuse may be fitted with suitable image stabilizing means, e.g. digital stabilizing using image processing techniques.

In case the projectile 10 comprises a functional warhead (main charge), e.g. an explosive charge, an igniting charge, an illuminating charge, etc. there must be provided a suitable ignition fuse 104. This fuse may be a strike activated fuse which is activated upon striking of the fuse 14 with a solid object, or a delay fuse which will activate the main charge only after a predetermined fraction of time after striking. Alternatively, the ignition fuse may be a heat sensitive fuse, a proximity fuse, etc. whereby an ignition flare passes through ignition tube 106.

Figure 3:
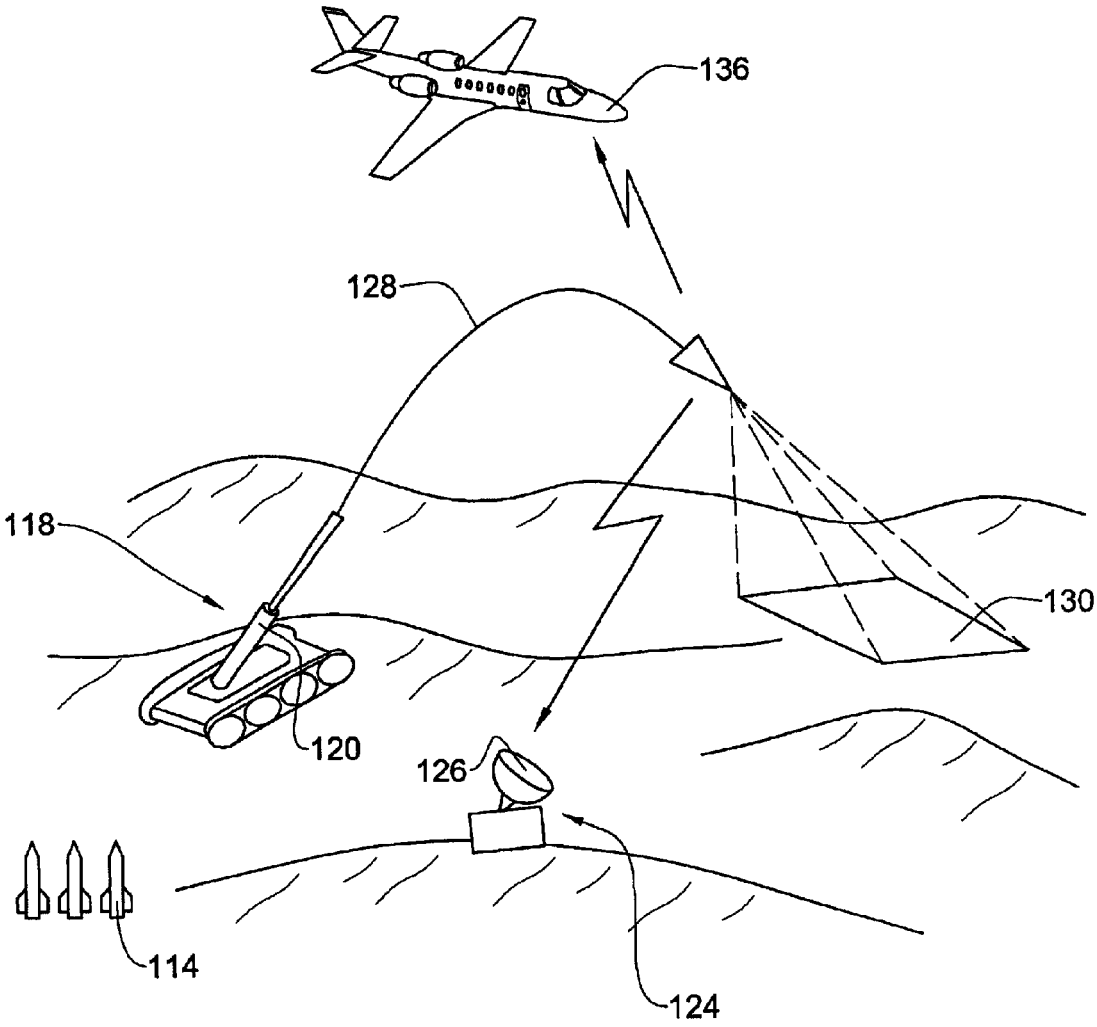
FIG. 3 is a schematic representation of a system according to an application of the present invention.

Further attention is now directed to FIG. 3 of the drawings in which an imaging system in accordance with the present invention is presented. The system comprises one or more projectiles which in the present example are gun shells of the type fired by a tank and to which a variety of fuses may be fitted. In the present example the projectiles designated 114 are fitted with an imaging fuse 14 as explained hereinbefore in connection with FIG. 1. A launching mechanism in the present example is a tank 118 fitted with a gun 120, though it is appreciated that rather than a tank there may be provided a mobile or stationary cannon, a mortar, a missile launcher, etc. as already mentioned in the preamble of the specification, a projectile as meant in the present invention denoted any object which may be launched or fired towards a target area, among others also from a high caliber machine gun.

The system further comprises a combined tracking and image data receiving unit 124 adapted for receiving a location signal (queuing signal) transmitted by RF beacon 46 whereby the tracking antenna 126 tracks and follows the trajectory of the projectile, illustrated by line 128. The ground station 124 is also adapted for receiving the image data signal transmitted from transmitter 90 of fuse 14 and processing it into an image or a solved image. It is appreciated that the location signal transmitted by the RF beacon 46 may be continuous or may be transmitted at an initial stage of the trajectory, as may be required until acquiring tracking by the ground station 124. Then, the antenna 126 may continue tracking by tracking the signal emitted from the image signal transmitter 90, using a Kalman filter of the trajectory.

The image data receiving and image processing unit fitted within ground station 124 is, in accordance with one embodiment of the invention, fitted with a reference image data of the entire scenery area. The launched projectile 114' transmits to the ground station 124 an image corresponding with a target area 130 which image is then transmitted by the transmitter 90 to the ground station 124 and is then processed to obtain an image. This image is then compared with the pre-stored reference image at the ground station for determining the precise location of the target image 130.

Comparing the image transmitted by the projectile 114' and that pre-stored at the image processing unit of the ground unit 124, one may access changes which took place at the target area, e.g. damage rate upon bombing, geological transformations after earthquakes, volcanic eruptions, fires, floods, etc., presence of hostile enemy forces, etc. As already mentioned herein above, the information may be retrieved even at poor conditions such as essentially low cloud bed, dust or smoke. Comparing the image data is carried out at a single pixel level, whereby it is possible to locate the geographic coordinates at significantly high accuracy (even less then one meter).

Furthermore, the system may compare and assess damage control of the target area after each round of shells by fitting an imaging fuse on each or some of the fired projectiles where an accurate and up-to-date image of the target area is obtained.

It is appreciated that rather than ground station 124 the image data receiving and image processing unit may be fitted on an airborne platform, namely an airplane 136 in FIG. 3.

Figure 4:
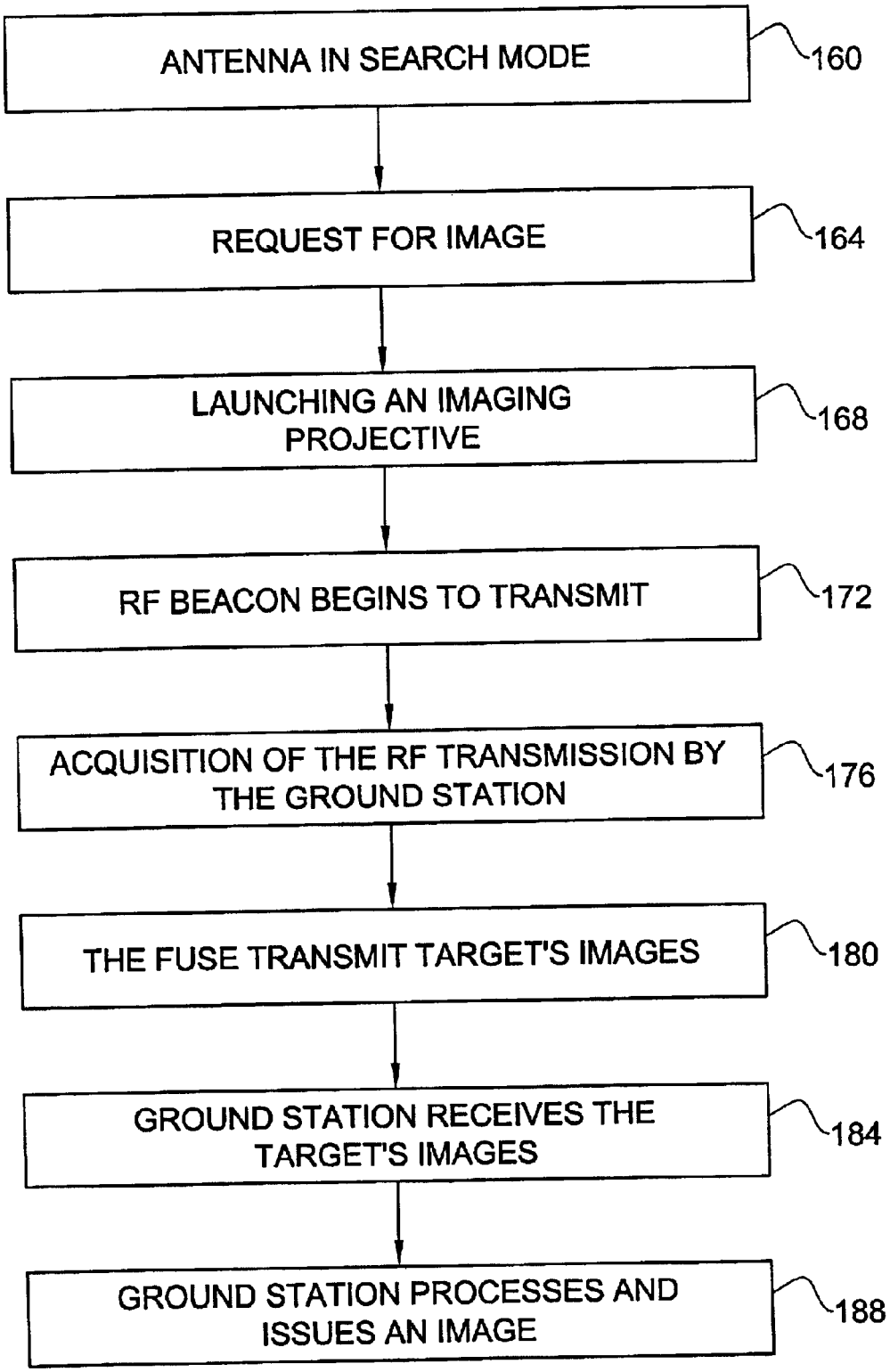
FIG. 4 is a flow chart of a method according to an application of the present invention.

FIG. 4 is a flow chart of a method in accordance with an application of the invention.

At step 160 the antenna of the image data receiving and image processing unit and of the tracking unit, e.g. ground unit 124 or airborne unit 136 in FIG. 3 is initiated into a search mode for seeking a location signal to be transmitted by an RF beacon of an imaging fuse as explained hereinabove. In step 164 a request for an image is placed, e.g. for reconnaissance support upon which an imaging projectile fitted with an imaging fuse is launched at step 168 by any suitable launching mechanism. Upon launching of the projectile or after a predetermined period of time, the RF beacon of the imaging fuse begins to transmit a location signal at step 172 which location signal is then picked up by the tracking system at step 176.

Then, the imaging fuse gains an image of the target area issuing an image signal transmitted and received by the ground station at step 184, said image signal being processed to obtain an image of the target area at step 188.

Whilst the description hereinabove describes a specific embodiment and several applications of the invention, it will be understood by those skilled in the art that the invention is not limited thereto and that other variations may be possible without departing from the scope and spirit of the invention herein disclosed.

What is claimed is:

1. An imaging fuse comprising a housing fixable within a receptacle at a fore end of a projectile, a coaxial support frame rotatably supported within the housing and fitted with an imaging assembly, said support frame being linearly axially displaceable with respect to the housing; an axial linear shock absorbing system intermediate the housing and the support frame; and a spin suppressing mechanism associated with the support frame, for suppressing its rotation with respect to the housing.

2. An imaging fuse according to claim 1, wherein the housing is screw-coupled within the receptacle of the projectile.

3. An imaging fuse according to claim 1, wherein the imaging assembly comprises an optical lens at a fore nose of the fuse, an imaging sensor, a power source and an image data and telemetry transmission assembly.

4. An imaging fuse according to claim 3, wherein there is further provided a CPU assembly interconnected with the imaging assembly.

5. An imaging fuse according to claim 1, wherein the support frame is rotatably supported within the housing by bearings.

6. An imaging fuse according to claim 1, wherein the imaging fuse is further provided with an ignition fuse for igniting a main charge of the projectile.

7. An imaging fuse according to claim 1, wherein the axial linear shock absorbing system comprises a plastically deformable member fitted between a bearing surface of the housing and a bearing surface of the support frame, wherein axial force applied on the support frame entails axial displacement thereof against the deformable member, resulting in deformation of the deformable member, and where the support frame returns to its original axial location upon diminishing of said axial force.

8. An imaging device according to claim 1, wherein the support frame is fitted with at least a pair of fins.

9. An imaging fuse according to claim 8, wherein at least one of the fins is sensitive to magnetic field and its orientation is controllable by a CPU received within the fuse and adapted for stabilizing rotation of the support frame relative to the earth.

10. An imaging fuse according to claim 1, wherein the support frame is engageable with respect to the hosing for arresting relative rotation therebetween, in case the projectile is a non-spin projectile.

11. An imaging fuse according to claim 1, wherein during flight of the projectile the frame is prevented from rotation with respect to the ground.

12. An imaging fuse according to claim 1, wherein the imaging assembly comprises one of an IR sensor, and a millimetric sensor and a visible sensor associated with a near IR illuminating source.

13. An imaging fuse according to claim 1, wherein portions of the support frame are lined with elastic cushioning material for supporting the imaging assembly.

14. An imaging fuse according to claim 1, further comprising an RF beacon for transmitting a location/queuing signal.

15. An imaging fuse according to claim 1, further comprising a generator for providing power source to the imaging assembly and to other power requiring assemblies, said generator adapted for translating respective rotary motion between the housing and he support frame.

16. An imaging projectile fitted at a fore end thereof with a imaging fuse comprising a housing, a coaxial support frame rotatably supported within the housing and fitted with an imaging assembly, said support frame being axially linearly displaceable with respect to the housing; a linear axial shock absorbing system intermediate the housing and the support frame; and a spin suppressing mechanism associated with the support frame, for suppressing rotation of the support frame with respect to the housing.

17. An imaging projectile according to claim 16, wherein at the fore end thereof there is a coupling arrangement for selectively attaching thereto a functional fuse for exciting a main charge of the projectile or the imaging fuse.

18. An imaging projectile according to claim 17, wherein the main charge of the projectile is excited by an ignition fuse fitted within the imaging fuse.

19. An imaging projectile according to claim 16, wherein during flight the imaging fuse support frame is prevented from rotation with respect to the ground.

20. An imaging projectile according to claim 16, wherein the support frame is fitted with at least a pair of fins.

21. An imaging projectile according to claim 20, wherein at least one of the fins is sensitive to magnetic field and its orientation is controllable by a CPU received within the imaging fuse and adapted for stabilizing the trajectory of the projectile.

22. An imaging system comprising:

(a) an imaging projectile fitted with an imaging fuse comprising a support frame with mounted therein an imaging assembly provided with an optical lens at a fore nose of the imaging fuse, an imaging sensor, a power source and an image data transmission assembly, said support frame being axially linearly displaceable with respect to the housing;

(b) launching mechanism for launching the imaging projectile in a direction of a target; and (c) an image data receiving and image processing unit for picking up data transmitted from the imaging fuse and processing it into a solved image;

(d) wherein the imaging fuse comprises a transmission beacon for signaling a location signal, and the data receiving and image processing unit is adapted for receiving said location signal and processing it to determine location of the projectile.

23. An imaging system according to claim 22, further comprising a tracking system adapted for receiving the location signal transmitted from the imaging fuse, processing the signal to determine location of the projectile and directing the tracking system to follow the projectiles trajectory.

24. An imaging system according to claim 22, wherein the location signal is transmitted for a restricted period of time.

25. An imaging system comprising:

(a) an imaging projectile fitted with an imaging fuse comprising a support frame with mounted therein an imaging assembly provided with an optical lens at a fore nose of the imaging fuse, an imaging sensor, a power source and an image data transmission assembly, said support frame being axially linearly displaceable with respect to the housing;

(b) launching mechanism for launching the imaging projectile in a direction of a target; and (c) an image data receiving and image processing unit for picking up data transmitted from the imaging fuse and processing it into a solved image;

wherein the data receiving and image processing unit further comprise an reference image database and wherein the image received at the image processing unit is compared with the reference image data for identifying location of the projectile and for assessing differences between the reference image and the processed image captured by the projectile.

26. An imaging method comprising;

(a) launching an imaging projectile fitted with an imaging fuse comprising a support frame with mounted therein an imaging assembly provided with an optical lens at a fore nose of the imaging fuse, an imaging sensor, a power source and an image data transmission assembly, said support frame being axially linearly displaceable wit respect to the housing;

(b) locating the position of the projectile and tracking it along its trajectory; and (c) receiving image data transmitted from the image fuse and processing it into a solved image;

(d) wherein the trajectory of the projectile is followed via a location signal, which is transmitted from the imaging fuse and received by a tracking assembly, whereby said signal is processed for issuing a location signal corresponding with the location of the projectile, said location signal then being transferred to an associated projectile tracking system.

27. An imaging method according to claim 26, wherein the location signal is transmitted for a restricted period of time.

28. An imaging method comprising:

(a) launching an imaging projectile fitted with an imaging fuse comprising a support frame with mounted therein an imaging assembly provided with an optical lens at a fore nose of the imaging fuse, an imaging sensor, a power source and an image data transmission assembly, said support frame being axially linearly displaceable wit respect to the housing;

(b) locating the position of the projectile and tracking it along its trajectory; and (c) receiving image data transmitted from the image fuse and processing it into a solved image;

wherein a database with a reference image is provided for comparing the processed image with said reference image, thereby determining the position of the projectile.

29. An imaging method comprising:

(a) launching an imaging projectile fitted with an imaging fuse comprising a support frame with mounted therein an imaging assembly provided with an optical lens at a fore nose of the imaging fuse, an imaging sensor, a power source and an image data transmission assembly, said support frame being axially linearly displaceable with respect to the housing;

(b) locating the position of the projectile and tracking it along its trajectory; and (c) receiving image data transmitted from the image fuse and processing it into a solved image;

wherein a database with a reference image is provided for comparing the processed image with said reference image, thereby assessing differences between the reference image and the processed image captured by the projectile.

30. An imaging method comprising:

(a) fitting an imaging fuse on a projectile so as to create an imaging projectile:

(b) launching the imaging projectile toward a target area;

(c) locating the position of the imaging projectile and tracking its a trajectory; and (d) receiving imaging data transmitted from the image fuse and processing it to obtain a solved image.

31. An imaging system comprising:

(a) a projectile formed at a fore end thereof with a fuse receptacle;

(b) an imaging fuse fixable to said fuse receptacle, said imaging fuse being provided with an imaging assembly;

(c) a launching mechanism for launching the projectile towards a target area;

(d) a tracking system for locating and tracking the trajectory of the projectile; and (e) an image data receiving and image processing unit adapted for picking up data acquired by the imaging assembly and transmitted from the fuse and for processing it into a solved image.

32. An imaging system according to claim 31, wherein during flight of the projectile the imaging assembly is prevented from rotation with respect to the ground.

* * * * *